US012466628B1

(12) United States Patent
Chew

(10) Patent No.: US 12,466,628 B1
(45) Date of Patent: Nov. 11, 2025

(54) COMPRESSION BAG

(71) Applicant: RODEON PROJECTS PTE. LTD., Singapore (SG)

(72) Inventor: Yang Zheng Gideon Chew, Singapore (SG)

(73) Assignee: RODEON PROJECTS PTE. LTD., Singapore (SG)

( * ) Notice: Subject to any disclaimer, the term of this patent is extended or adjusted under 35 U.S.C. 154(b) by 0 days.

(21) Appl. No.: 19/206,082

(22) Filed: May 13, 2025

Related U.S. Application Data

(63) Continuation of application No. PCT/IB2025/054820, filed on May 8, 2025.

(30) Foreign Application Priority Data

May 13, 2024 (CN) ..... 202421034596.2

(51) Int. Cl.
*B65D 81/20* (2006.01)
*B65D 33/04* (2006.01)
*B65D 33/25* (2006.01)

(52) U.S. Cl.
CPC ..... *B65D 81/2023* (2013.01); *B65D 33/04* (2013.01); *B65D 33/2508* (2013.01)

(58) Field of Classification Search
CPC . B65D 33/04; B65D 33/2508; B65D 81/2023
USPC ..... 206/524.8; 383/3, 103, 120, 123, 124
See application file for complete search history.

(56) References Cited

U.S. PATENT DOCUMENTS

| | | | | |
|---|---|---|---|---|
| 5,059,036 | A | 10/1991 | Richison et al. | |
| 5,203,458 | A * | 4/1993 | Cornwell | B65D 33/1691 383/62 |
| 7,510,326 | B2 * | 3/2009 | Chen | B65D 77/225 206/524.8 |
| 8,434,614 | B2 * | 5/2013 | Sato | B65D 81/268 206/524.8 |
| 2002/0162767 | A1 * | 11/2002 | Ohtsubo | B65D 81/203 206/524.8 |

(Continued)

FOREIGN PATENT DOCUMENTS

| | | |
|---|---|---|
| CN | 210213290 U | 3/2020 |
| CN | 210708636 U | 6/2020 |

(Continued)

*Primary Examiner* — Luan K Bui
(74) *Attorney, Agent, or Firm* — Bayramoglu Law Offices LLC

(57) ABSTRACT

A compression bag is provided. The compression bag includes a bag body, a sealing strip, and a one-way valve, where two sides of the bag body are respectively folded inwardly to form folding portions; portions between the folding portions respectively form bag sheets; two ends of the bag body are sealed; an edge of at least one end of the bag body is thermocompression-sealed; an elongated hole and a valve hole are formed in the bag body; the sealing strip is fixedly provided in the elongated hole; and the one-way valve is fixedly provided in the valve hole, and allows unidirectional flow from inside to outside. At two sides of the compression bag, the folding portions for changing a volume through expansion and contraction and the bag sheets connected between the folding portions are all obtained by folding different parts of the bag body.

12 Claims, 13 Drawing Sheets

(56) References Cited

U.S. PATENT DOCUMENTS

| | | | | |
|---|---|---|---|---|
| 2011/0103716 | A1* | 5/2011 | Reilly | B65D 75/008 383/103 |
| 2011/0162995 | A1* | 7/2011 | Epicureo | B65D 85/18 206/524.8 |
| 2016/0152399 | A1* | 6/2016 | Inagaki | B65D 79/005 383/103 |
| 2023/0339655 | A1 | 10/2023 | Clottin Basini | |

FOREIGN PATENT DOCUMENTS

| | | | |
|---|---|---|---|
| CN | 212654777 | U | 3/2021 |
| CN | 222203430 | U | 12/2024 |
| JP | 2018034903 | A | 3/2018 |

* cited by examiner

COMPRESSION BAG

CROSS-REFERENCE TO THE RELATED APPLICATIONS

This application is a continuation application of International Application No. PCT/IB2025/054820, filed on May 8, 2025, which is based upon and claims priority to Chinese Patent Application No. 202421034596.2, filed on May 13, 2024, the entire contents of which are incorporated herein by reference.

TECHNICAL FIELD

The present disclosure relates to the technical field of vacuum compression bags, and in particular to a compression bag.

BACKGROUND

A vacuum compression bag is a storage bag that can evacuate air and enable the atmospheric pressure to naturally compress internal items. In daily life, it is mainly applied to household storage for clothing and bedding, travel storage for a change of clothes, etc. The vacuum compression bag can be used to store cotton quilts, cotton-padded clothes, pillows, blankets, towels, and other highly compressible items. It not only can save storage space, but also can achieve moisture-proof, mildew-resistant and anti-odor effects, and prevent the growth of bacteria and mites.

However, the existing vacuum compression bags are prone to air leakage at their corners in use, such that the interior of the vacuum compression bag communicates with the outside and blows up. This leads to growth of mildew on the clothing in the vacuum compression bag, compression failure of the vacuum compression bag, and bag expansion, and takes up more space.

Therefore, the technical problem to be solved urgently in the field is to provide a vacuum compression bag with desirable sealing performance.

SUMMARY

The present disclosure aims to solve one of the technical problems in the related art to some extent. In view of this, the present disclosure provides a compression bag. The compression bag has desirable sealing performance, and can improve storage efficiency and prevent mildew of the clothing.

To achieve the above objective, the present disclosure provides a compression bag. The compression bag includes a bag body, a sealing strip, and a one-way valve, where two sides of the bag body are respectively folded inwardly to form folding portions; portions between the folding portions respectively form bag sheets; two ends of the bag body are sealed; an edge of at least one end of the bag body is thermocompression-sealed; an elongated hole and a valve hole are formed in the bag body; the sealing strip is fixedly provided in the elongated hole, and can be configured to selectively open or seal the elongated hole; the one-way valve is fixedly provided in the valve hole; and the one-way valve allows unidirectional flow from inside to outside, ensuring that a fluid (for example, which may include gas) in the compression bag is discharged through the valve hole.

Optionally, edges of the two ends of the bag body are thermocompression-sealed.

Optionally, an edge of a first end of the bag body is thermocompression-sealed; a second end of the bag body is provided with a bottom bag sheet; and a periphery of the bottom bag sheet is thermocompression-bonded to a corresponding bag sheet and a corresponding folding portion, so as to seal the second end of the bag body.

Optionally, both the elongated hole and the valve hole are formed in the bag sheet.

Optionally, the folding portion includes a pair of folding sheets stacked between the bag sheets; at the at least one end of the bag body with the thermocompression-sealed edge, edges of the folding sheets corresponding to the at least one end of the bag body are respectively thermocompression-bonded to edges of adjacent bag sheets, and edges of ends of the adjacent bag sheets located between the folding portions are thermocompression-bonded to each other; and at the end of the bag body provided with the bottom bag sheet, edges of ends of the folding sheets are thermocompression-bonded to an edge of the bottom bag sheet.

Optionally, edges of the folding sheets of at least one folding portion corresponding to at least one side of the end of the bag body are thermocompression-bonded to each other.

Optionally, a viewing window is formed on the bag body; and light transmittance of the viewing window of the bag body is greater than light transmittance of other regions of the bag body.

Optionally, the viewing window is located on the bag sheet, and the viewing window extends from the folding portion at one side of the bag body to the folding portion at the other side of the bag body.

Optionally, the viewing window is provided around the bag body.

Optionally, the viewing window is located on the bag sheet, and the viewing window extends from one end of the bag body to the other end of the bag body.

Optionally, the sealing strip and the one-way valve are provided on the same bag sheet as the viewing window; and the sealing strip and the one-way valve are respectively located at two sides of the viewing window.

Optionally, an extension direction of the sealing strip is parallel to an extension direction of the viewing window.

Optionally, the one-way valve is located at a center of a region of the bag sheet corresponding to one side of the viewing window.

Optionally, the bag sheet includes a light-transmissive sheet and connection sheets respectively connected to two sides of the light-transmissive sheet; and a portion of the light-transmissive sheet not overlapped with the connection sheet forms the viewing window.

Optionally, light transmittance of the light-transmissive sheet is not less than 30%.

Optionally, the compression bag has a size of 150 mm to 500 mm along a width direction in which a laminated edge extends.

Optionally, the compression bag has the size of 220 mm to 430 mm along the width direction.

Optionally, the compression bag has a size of 200 mm to 800 mm along a length direction.

Optionally, the compression bag has the size of 370 mm to 670 mm along the length direction.

Optionally, the viewing window has a size of 60 mm to 300 mm along the width direction.

Optionally, the viewing window has the size of 85 mm to 180 mm along the width direction.

Optionally, the lamination has a width of 20 mm to 90 mm.

Optionally, the lamination has the width of 45 mm to 75 mm.

Optionally, the sealing strip extends from one end of the bag body to the other end of the bag body, or the sealing strip extends along an edge of an end of the bag body; and a force application hole is formed in a laminated edge of the end of the bag body; the force application hole penetrates through the laminated edge along a thickness direction; and a position of the force application hole corresponds to a position of an end of the sealing strip.

Optionally, the sealing strip includes a zipper; the zipper includes a slider, a first teeth set, and a second teeth set; the first teeth set includes a plurality of first zipper teeth; the second teeth set includes a plurality of second zipper teeth; the first teeth set and the second teeth set are respectively fixedly provided at two side edges of the elongated hole, and distributed along an extension direction of the elongated hole; and the slider is configured to move along the elongated hole and engage or disengage the first teeth set and the second teeth set.

Optionally, the zipper further includes a first connection sheet and a second connection sheet; the first teeth set is fixedly provided on the first connection sheet; the second teeth set is fixedly provided on the second connection sheet; and an outer edge of the first connection sheet and an outer edge of the second connection sheet are respectively thermocompression-bonded to the two side edges of the elongated hole.

Optionally, a material of the bag body includes thermoplastic.

Optionally, a laminated edge reinforcing portion is further provided on the laminated edge; the laminated edge reinforcing portion is overlaid on the laminated edge; and the force application hole penetrates through the laminated edge reinforcing portion and the laminated edge along the thickness direction.

Optionally, the force application hole is located at a corner of the bag body; and the force application hole is in the shape of any one of a triangle, an approximate triangle, a trapezoid, and an approximate trapezoid.

Optionally, the laminated edge reinforcing portion corresponds to the force application hole in shape.

Optionally, the laminated edge reinforcing portion and the laminated edge are thermocompression-bonded.

Optionally, a material of the laminated edge reinforcing portion is the same as a material of the lamination.

Optionally, the laminated edge reinforcing portion is made of a rubber material.

Optionally, the bag sheet and the lamination each have a thickness of 0.3 mm to 0.8 mm.

Preferably, the bag sheet and the lamination each have the thickness of 0.4 mm to 0.5 mm.

Preferably, the bag sheet and the lamination each have the thickness of 0.45 mm.

Optionally, the laminated edge reinforcing portion has a thickness of 0.1 mm to 0.3 mm.

Preferably, the laminated edge reinforcing portion has the thickness of 0.2 mm.

Optionally, the one-way valve includes a valve body, a sealing cover, and a flexible connecting portion; the valve body is fixedly provided in the valve hole, and allows unidirectional flow from inside to outside; the sealing cover is connected to the valve body through the flexible connecting portion; and the sealing cover can be configured to seal an air outlet of the valve body.

Optionally, the valve body includes a valve seat and a valve disc; the valve seat is fixedly provided in the valve hole, and an outlet chamber is formed in the valve seat; the air outlet is formed in a top of the outlet chamber; a communicating hole communicating with an interior of the bag body is formed in a bottom of the outlet chamber; and the valve disc is movably provided in the outlet chamber, and can be configured to block the communicating hole under an air pressure outside the bag body.

Optionally, a side of the sealing cover away from the flexible connecting portion is provided with a holding portion; and the holding portion extends along a direction away from the flexible connecting portion.

In the present disclosure, two sides of the compression bag are respectively provided with the inwardly folded folding portions. Through expansion and contraction of the folding portions, flexible storage space can be provided for the clothing in the bag. Moreover, the sealing strip is further fixedly provided on the compression bag. The sealing strip can be configured to selectively open the elongated hole to take and place the clothing conveniently, or seal the elongated hole to prevent outside air from entering the compression bag. The one-way valve allows unidirectional flow from inside to outside, ensuring that air is evacuated to the outside, and the outside air is prevented from entering the compression bag upon evacuation, keeping the interior of the compression bag at a low pressure.

Furthermore, a bag body of the compression bag is a cylindrical structure before two ends of the bag body are sealed. At two sides of the bag body, the folding portions for changing a volume through expansion and contraction and the bag sheets connected between the folding portions are all obtained by folding different parts of the same bag body. Only the two ends of the bag body are provided with an opening. After the bag body is sealed, the laminated edge is only formed at the end of the bag body. Compared with the spliced bag body in the related art, the present disclosure can effectively improve airtightness of the compression bag. Besides, an edge of at least one end of the bag body is sealed by thermocompression to form the laminated edge. This prevents adhesive failure, water seepage, air leakage and the like of the adhesion solution, and further ensures the airtightness of the compression bag, thereby ensuring storage efficiency as well as moisture-proof, mildew-resistant and anti-odor effects of the compression bag.

BRIEF DESCRIPTION OF THE DRAWINGS

The present disclosure will be further described below with reference to the accompanying drawings.

REFERENCE NUMERALS

Figure 1:
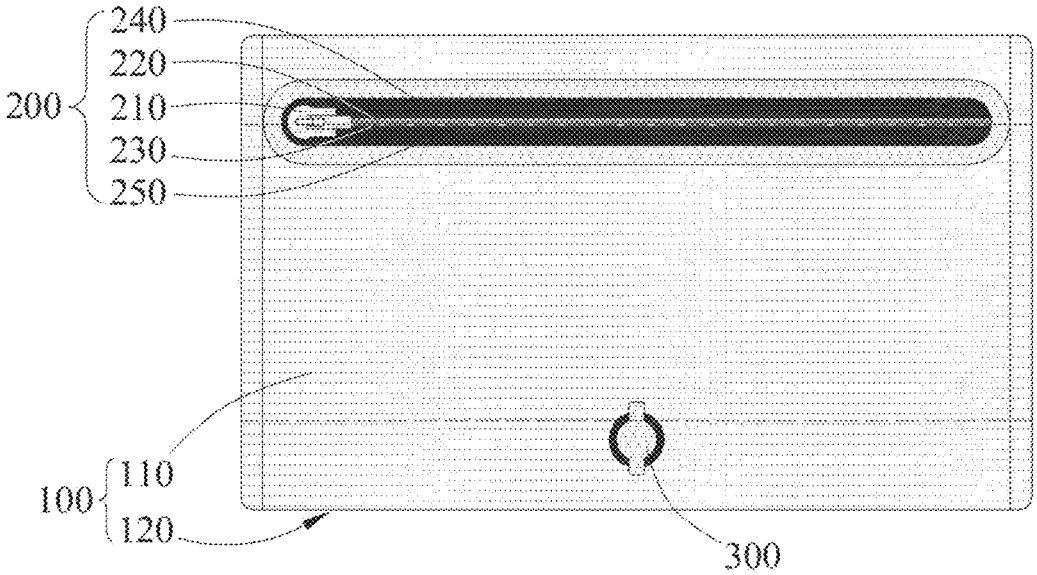
FIG. 1 is a front schematic structural view of a compression bag according to an embodiment of the present disclosure.

100: bag body, 110: bag sheet, 111: light-transmissive sheet, 112: connection sheet, 120: folding portion, 121: lamination, 130: laminated edge, 200: sealing strip, 210: slider, 220: first teeth set, 230: second teeth set, 240: first connection sheet, 250: second connection sheet, 300: one-way valve, 310: valve body, 320: sealing cover, 321: holding portion, 330: flexible connecting portion, 400: viewing window, 510: force application hole, 520: laminated edge reinforcing portion, 10: sheet material, 11: elongated hole, and 12: valve hole.

DETAILED DESCRIPTION OF THE EMBODIMENTS

The embodiments of the present disclosure are described below in detail. Examples of the embodiments are shown in the drawings. The same or similar numerals represent the same or similar elements or elements having the same or similar functions throughout the specification. The embodiments in implementations are only used to explain the present disclosure, and should not be construed as a limitation to the present disclosure.

The term "one embodiment" or "embodiment" or "example" referred to in the description means that a specific feature, structure or characteristic described in connection with the embodiment can be included in at least one embodiment of the present disclosure. The phrase "in an embodiment" in the description unnecessarily refers to the same embodiment.

In the related art, the vacuum compression bag is typically a polyhedral structure. In manufacture, a plurality of sheets are usually spliced to form a plurality of sidewalls of a bag body. Seams between the sidewalls are sealed by an adhesive material. As a result, the existing vacuum compression bag has many spliced seams, which may create numerous potential leakage points. During use, the seams are highly prone to ruptures to cause air leakage and failure.

In order to solve the above technical problem, the present disclosure provides a compression bag. As shown in FIG. 1 to FIG. 12, and FIG. 21 to FIG. 25, the compression bag includes bag body 100, sealing strip 200, and one-way valve 300. Two sides of the bag body 100 are respectively folded inwardly to form folding portions 120. Portions between the folding portions 120 respectively form bag sheets 110. Two ends of the bag body 100 are sealed. An edge of at least one end of the bag body 100 is thermocompression-sealed. An elongated hole and a valve hole are formed in the bag body 100. The sealing strip 200 is fixedly provided in the elongated hole. The sealing strip 200 can be configured to selectively open or seal the elongated hole. The one-way valve 300 is fixedly provided in the valve hole. The one-way valve 300 allows unidirectional flow from inside to outside, ensuring that a fluid (such as gas) in the compression bag is discharged through the valve hole.

Figure 2:
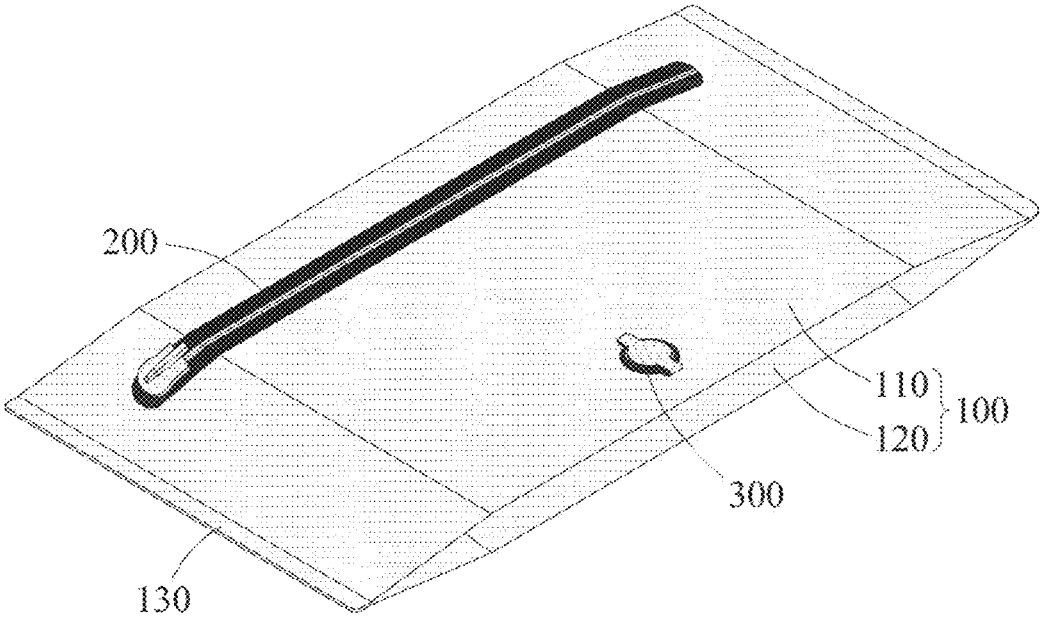
FIG. 2 is a schematic structural view of a compression bag according to an embodiment of the present disclosure.
Figure 3:
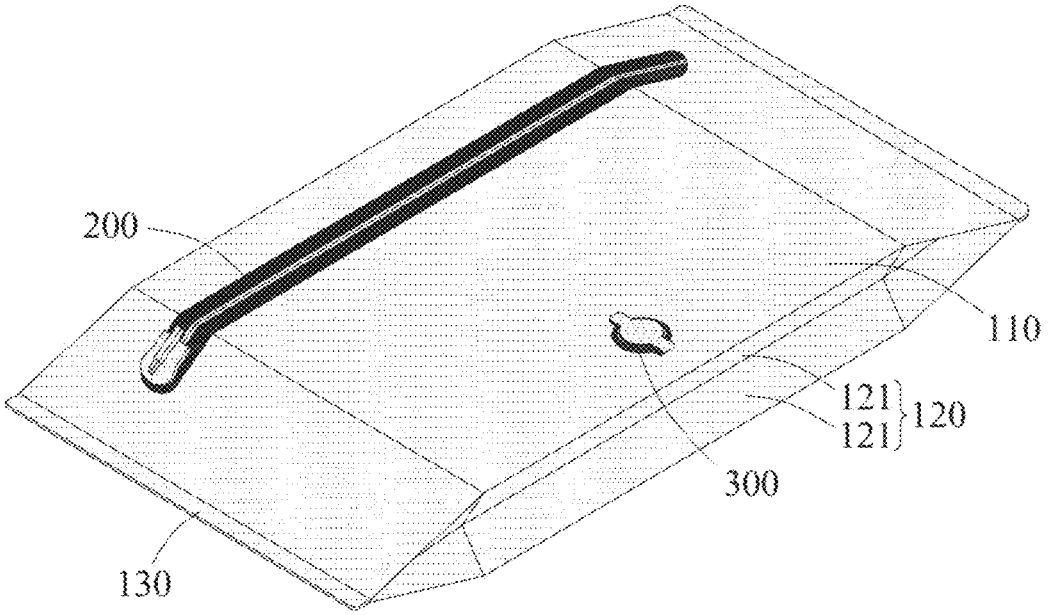
FIG. 3 is a schematic structural view after a certain amount of air is inflated to the compression bag in FIG. 2.
Figure 4:
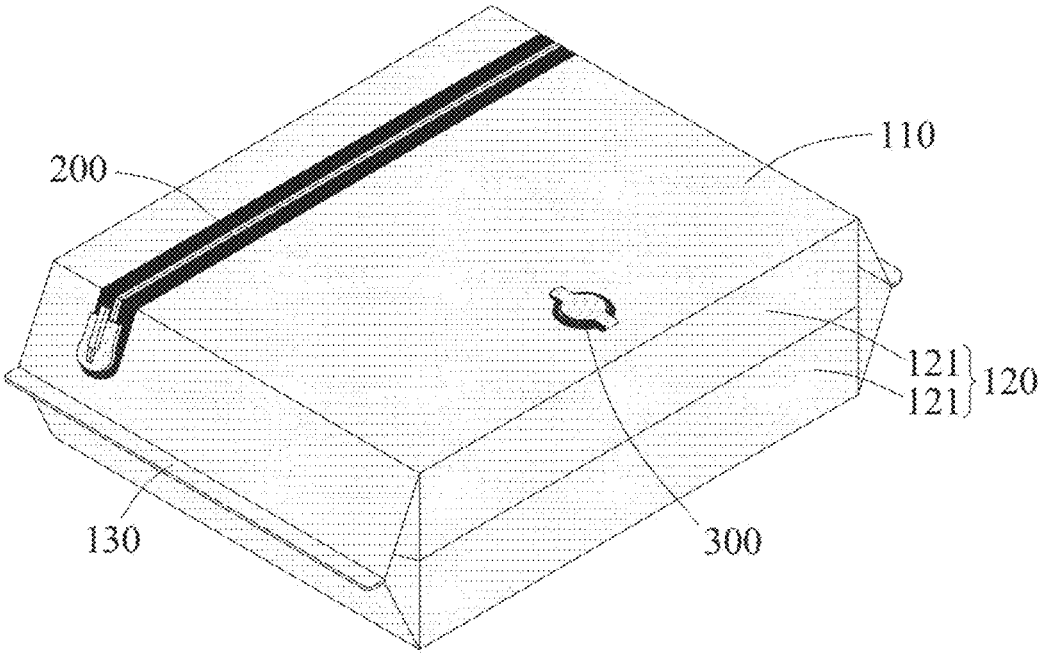
FIG. 4 is a schematic structural view after more air is inflated to the compression bag in FIG. 3.

It is to be understood that the folding portions 120 formed by inwardly folding the two sides of the bag body 100 can be expanded in case of a large amount of clothing in the bag, creating more storage space between upper and lower bag sheets 110. Specifically, in response to an idle state, as shown in FIG. 2, the folding portions 120 are entirely folded and accommodated between the bag sheets 110. By this time, a front view of the compression bag is as shown in FIG. 1. After the clothing is placed into the compression bag, as shown in FIG. 3, the upper and lower bag sheets 110 are pushed apart by the clothing therebetween, causing the folding portions 120 connected to edges of the bag sheets 110 to expand accordingly. After a sufficient amount of clothing is placed into the compression bag, as shown in FIG. 4, the folding portions 120 are tensioned flat, resulting in a maximum distance between the upper and lower bag sheets 110 to provide adequate storage space for the clothing.

In the present disclosure, two sides of the compression bag are respectively provided with the inwardly folded folding portions 120. Through expansion and contraction of the folding portions 120, flexible storage space can be provided for the clothing in the bag. Moreover, the sealing strip 200 is further fixedly provided on the compression bag. By opening the sealing strip 200, the elongated hole is opened, so as to take and place the clothing conveniently. Alternatively, the elongated hole is sealed by the sealing strip to prevent outside gas from entering the compression bag. The one-way valve 300 allows unidirectional flow from inside to outside, ensuring that air in the compression bag is evacuated from the outside, and the outside air is prevented from entering the compression bag upon evacuation, keeping the interior of the compression bag at a low pressure.

A bag body of the compression bag is a cylindrical structure before two ends of the bag body are sealed. At two sides of the bag body, the folding portions 120 for changing a volume of the bag body through expansion and contraction and the bag sheets 110 connected between the folding portions 120 are all obtained by folding different parts of the same bag body 100. Only the end of the bag body 100 is provided with an opening. After the bag body is sealed, laminated edge 130 is only formed at the end of the bag body. Compared with the spliced bag body in the related art, the bag body 100 provided by the embodiment of the present disclosure can effectively improve airtightness of the compression bag. Besides, an edge of at least one end of the bag body 100 is sealed by thermocompression (namely a process in which two materials are heated, with heated positions molten and fused to each other to form a whole) to form the laminated edge 130. This prevents adhesive failure, water seepage, air leakage and the like of the adhesion solution, and further ensures the airtightness of the compression bag, thereby ensuring storage efficiency as well as moisture-proof, mildew-resistant and anti-odor effects of the compression bag.

In some implementations of the present disclosure, as shown in FIG. 1 to FIG. 12, FIG. 23, FIG. 24, and FIG. 25, edges of two ends of the bag body 100 are respectively thermocompression-sealed to form laminated edges 130.

Figure 21:
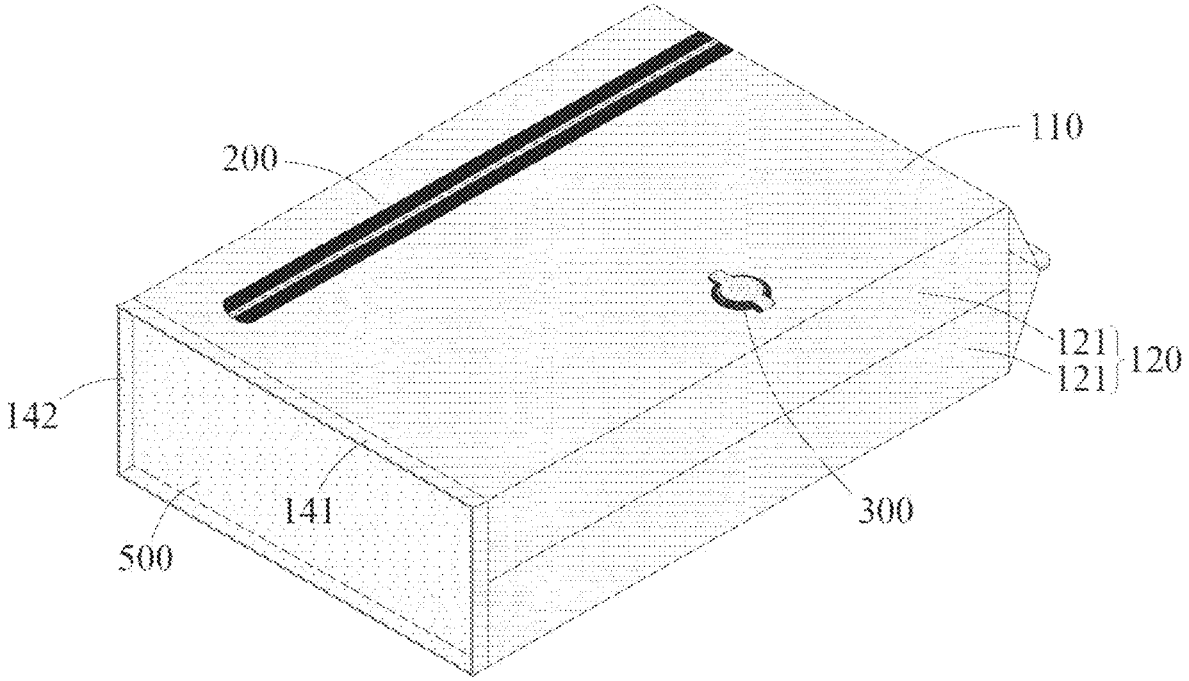
FIG. 21 is a schematic structural view of a compression bag according to another embodiment of the present disclosure.
Figure 22:
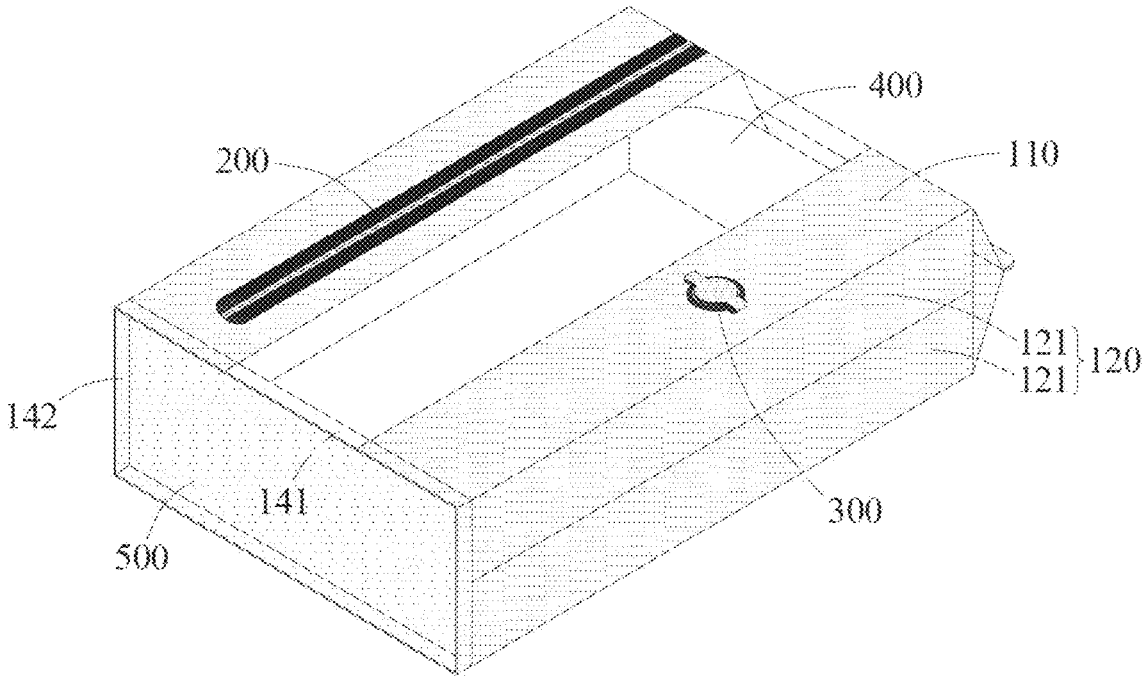
FIG. 22 is a schematic structural view of a compression bag according to another embodiment of the present disclosure.

Alternatively, in other implementations of the present disclosure, as shown in FIG. 21 and FIG. 22, an edge of a first end of the bag body 100 is thermocompression-sealed to form laminated edge 130. A second end of the bag body 100 is provided with bottom bag sheet 500. A periphery of the bottom bag sheet 500 is thermocompression-bonded to the corresponding bag sheet 110 and the corresponding folding portion 120, so as to seal the second end of the bag body 100.

As an optional implementation of the present disclosure, as shown in FIG. 3, FIG. 4, FIG. 8, FIG. 10, FIG. 12, and FIG. 21 to FIG. 25, both the elongated hole and the valve hole are formed in the bag sheet 110. Accordingly, the sealing strip 200 and the one-way valve 300 are also provided on the bag sheet 110.

As an optional implementation of the present disclosure, as shown in FIG. 3, FIG. 4, FIG. 8, FIG. 10, and FIG. 12, the folding portion 120 includes a pair of folding sheets 121 stacked between the bag sheets 110. At the end of the bag body 100 with the thermocompression-sealed edge, edges of the folding sheets 121 corresponding to the end of the bag body 100 are respectively thermocompression-bonded to edges of adjacent bag sheets 110. Edges of ends of the adjacent bag sheets 110 located between the folding portions 120 are thermocompression-bonded to each other.

As shown in FIG. 21 and FIG. 22, at the end of the bag body 100 provided with the bottom bag sheet 500, edges of ends of the folding sheets 121 are thermocompression-bonded to an edge of the bottom bag sheet 500.

In the embodiment of the present disclosure, the folding portion 120 is folded in half to form the pair of folding sheets 121 (the position shown by a dashed line in FIG. 1, FIG. 7, FIG. 9, and FIG. 11 represents a fold line between the folding sheets 121). In response to the idle state, two folding sheets 121 of the folding portion 120 are stacked and accommodated between the bag sheets 110, and are respectively attached to the upper and lower bag sheets 110. An edge of the lamination 121 corresponding to the end of the bag body 100 is thermocompression-bonded to the bag sheet 110 to which the lamination is attached, or thermocompression-bonded to the corresponding bottom bag sheet 500 (referring to FIG. 21 and FIG. 22). Therefore, two ends of the bag body 100 are sealed to ensure the airtightness of the bag body of the compression bag.

Figure 5:
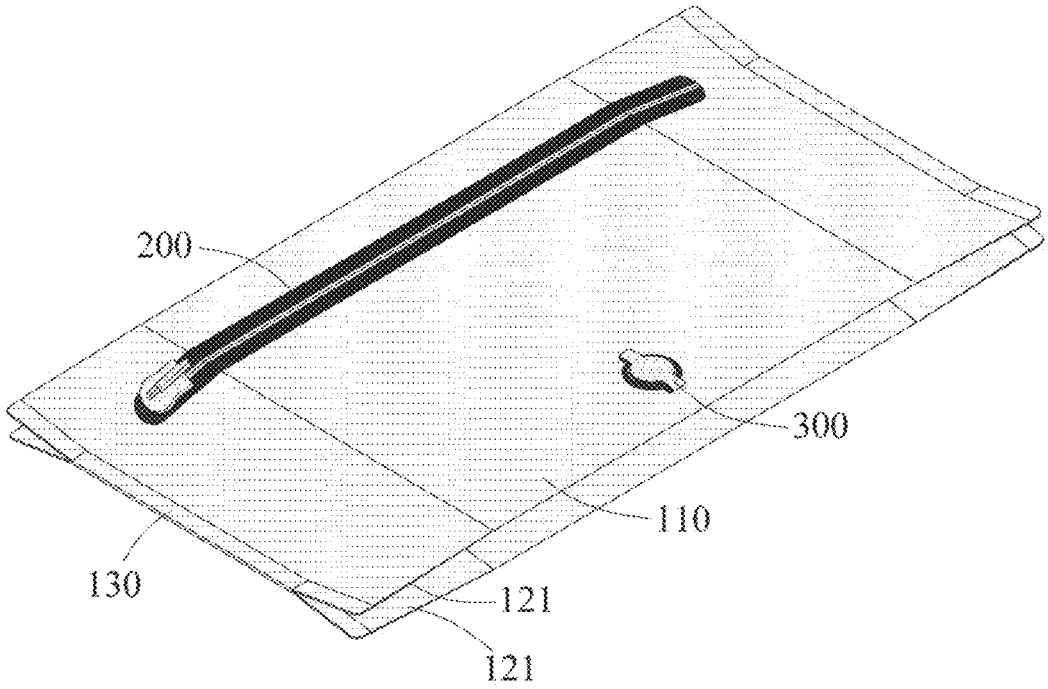
FIG. 5 is a front schematic structural view of a compression bag according to another embodiment of the present disclosure.

As shown in FIG. 5, in some embodiments of the present disclosure, edges of two folding sheets 121 of the folding portion 120 corresponding to the end of the bag body 100 may be split.

Alternatively, as an optional implementation of the present disclosure, as shown in FIG. 2 to FIG. 4, and FIG. 6, edges of the folding sheets 121 of at least one folding portion 120 corresponding to at least one side of the end of the bag body 100 are thermocompression-bonded to each other. That is, when the two ends of the bag body 100 are thermocompression-sealed, the two folding sheets 121 and two bag sheets 110 outside the two folding sheets 121 are all thermocompressed into a whole.

Figure 6:
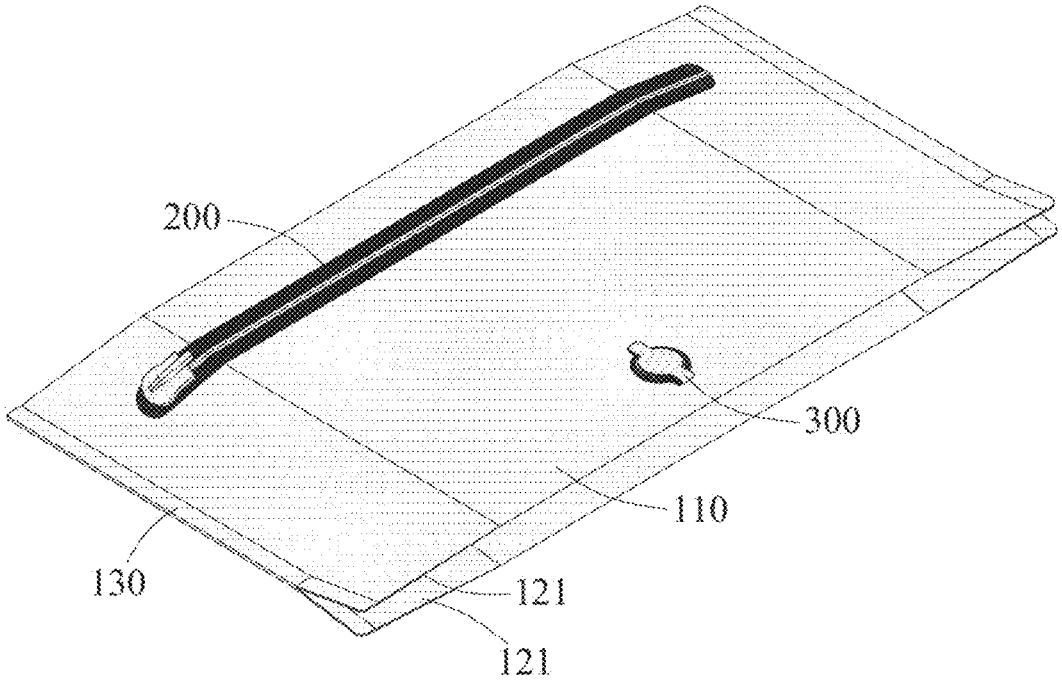
FIG. 6 is a front schematic structural view of a compression bag according to another embodiment of the present disclosure.

As shown in FIG. 6, in some embodiments of the present disclosure, only the folding sheets 121 of the folding portion 120 at one side of the bag sheet 110 are split, while edges of the folding sheets 121 of the folding portion 120 at the other side of the bag sheet 110 are thermocompression-bonded into a whole.

In other embodiments of the present disclosure, edges of ends of the folding sheets 121 may also be thermocompression-bonded into a whole, and edges of the other ends of the folding sheets are split.

In response to household scenarios for searching the clothing, and travel scenarios where specific clothing or item is used urgently, it is frequent to forget the bag to which the searched item is stored. In order to find the item, a plurality of compression bags are often deflated and opened one by one. After the item is get, the opened compression bag must be resealed, re-evacuated, and restored to the original position. This process is time-consuming and laborious.

In order to solve this technical problem, as a preferred implementation of the present disclosure, as shown in FIG. 7, FIG. 8, FIG. 11, and FIG. 12, viewing window 400 is formed in the bag sheet 110. Light transmittance of the viewing window 400 of the bag body 100 is greater than light transmittance of other regions of the bag body 100.

In the embodiment of the present disclosure, the viewing window 400 is formed on the bag body 100, and light transmittance of the viewing window 400 is greater than light transmittance of other positions of the bag body 100. While the compression bag is not opened, items in the compression bag can be observed through the viewing window 400. This can quickly find a desired item, omit the time for opening the bag, finding the item and re-evacuating the compression bag for sealing, and improve user experience.

Figure 24:
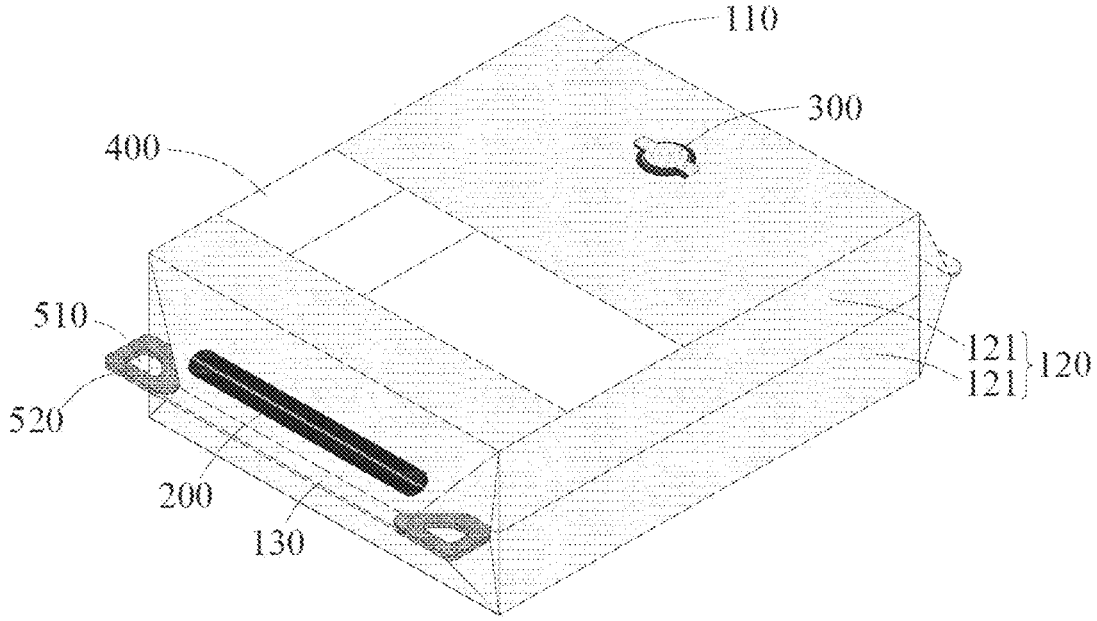
FIG. 24 is a schematic structural view of a compression bag according to another embodiment of the present disclosure.

As an optional implementation of the present disclosure, as shown in FIG. 24, the viewing window 400 is located on the bag sheet 110. The viewing window 400 extends from the folding portion 120 at one side of the bag body 100 to the folding portion 120 at the other side of the bag body 100.

Figure 25:
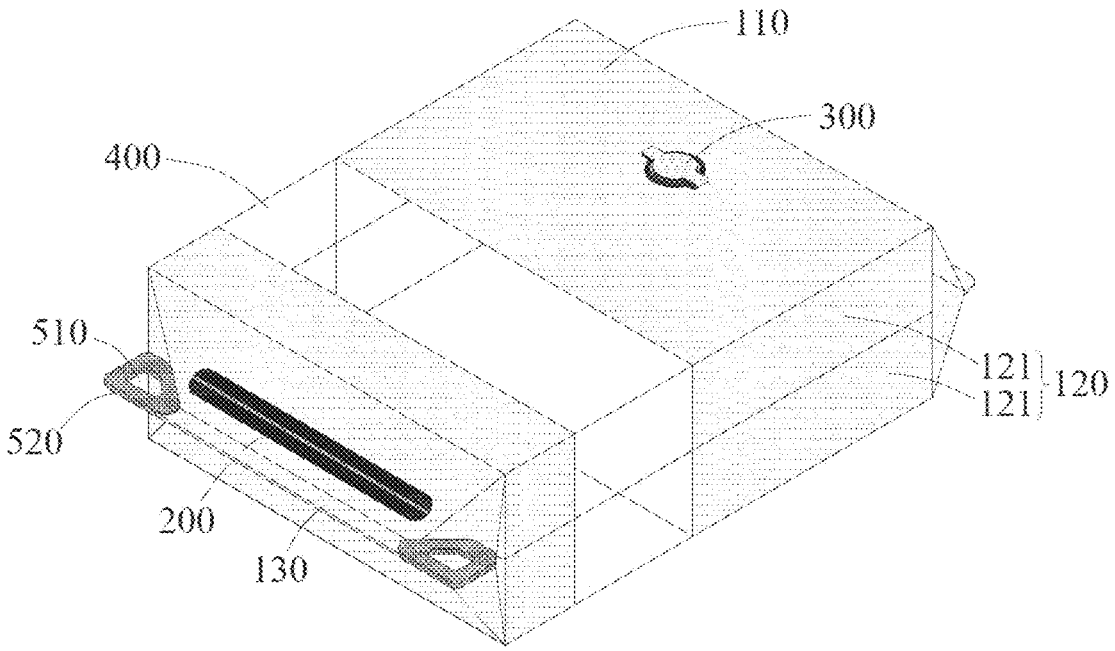
FIG. 25 is a schematic structural view of a compression bag according to another embodiment of the present disclosure.

As another optional implementation of the present disclosure, as shown in FIG. 25, the viewing window 400 is formed around the bag body 100. That is, the viewing window 400 passes through the bag sheet 110 and the lamination 121 in sequence and is wrapped around the bag body by one circumference.

As a preferred implementation of the present disclosure, as shown in FIG. 7, FIG. 8, FIG. 11, FIG. 12, and FIG. 22, the viewing window 400 is located on the bag sheet 110. The viewing window 400 extends from one end of the bag body 100 to the other end of the bag body 100.

In the embodiment of the present disclosure, a length direction of the viewing window 400 is the same as a length direction of the bag body 100. In manufacture of the compression bag, a material of the viewing window 400 may be cut at the same time with other materials of the bag body 100, which can simplify a manufacturing process of the viewing window 400. Besides, the viewing window 400 can replace the laminated edge at the seam of the bag made of a single material, thereby improving overall aesthetic of the compression bag.

Figure 7:
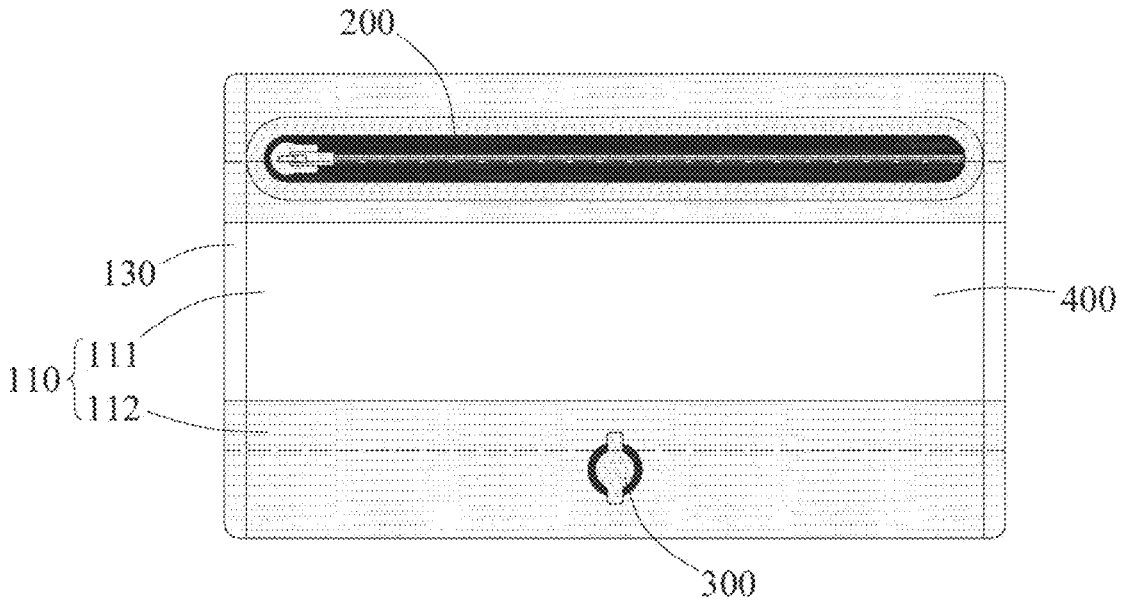
FIG. 7 is a front schematic structural view of a compression bag according to an embodiment of the present disclosure.
Figure 8:
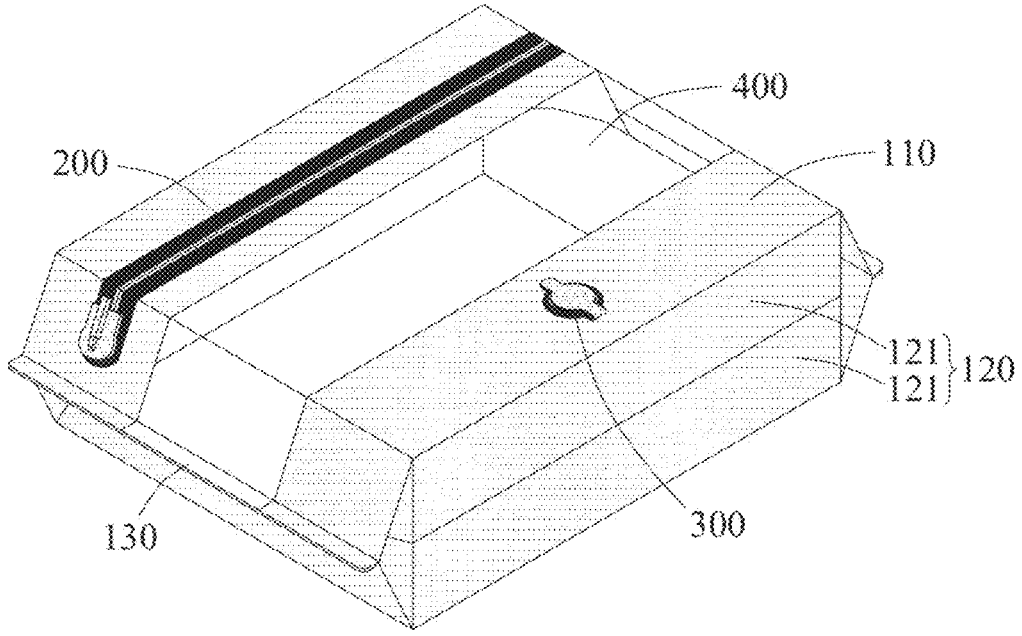
FIG. 8 is a three-dimensional (3D) schematic structural view after air is inflated to the compression bag in FIG. 7.
Figure 9:
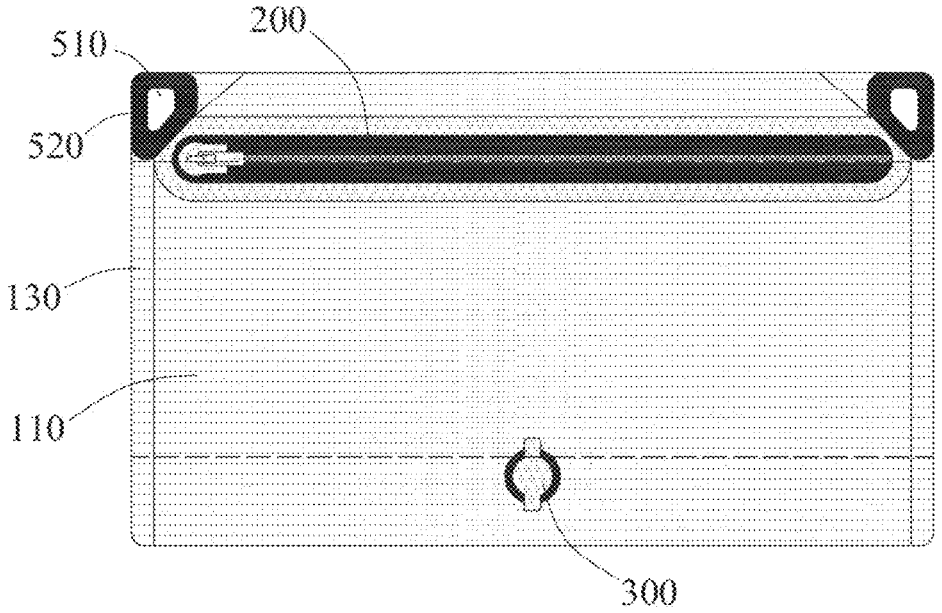
FIG. 9 is a front schematic structural view of a compression bag according to an embodiment of the present disclosure.
Figure 10:
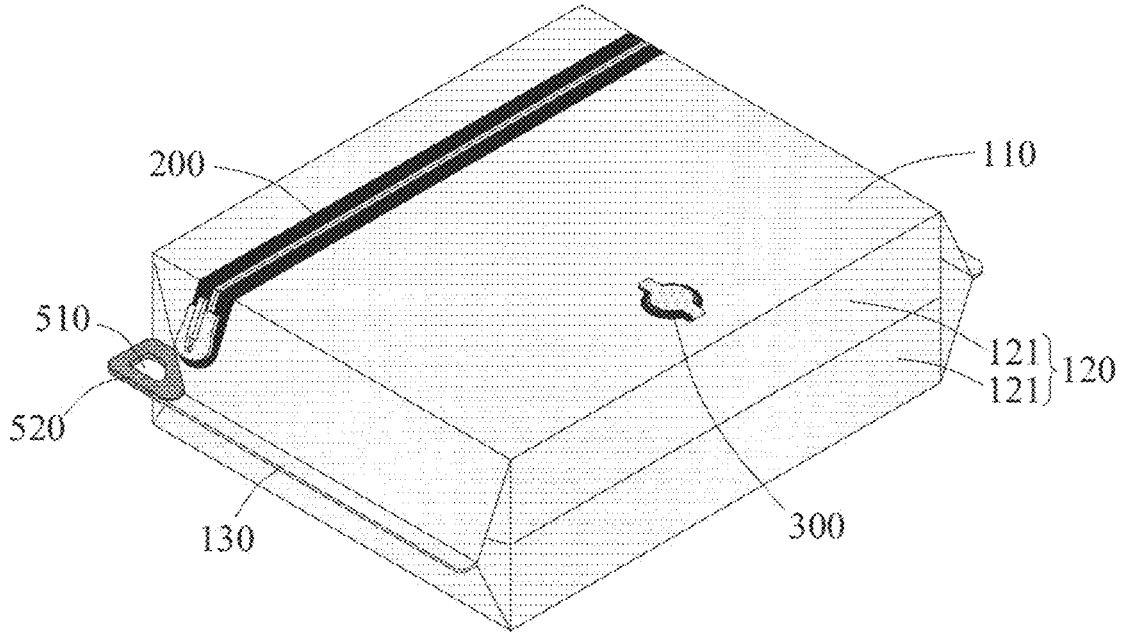
FIG. 10 is a 3D schematic structural view after air is inflated to the compression bag in FIG. 9.
Figure 11:
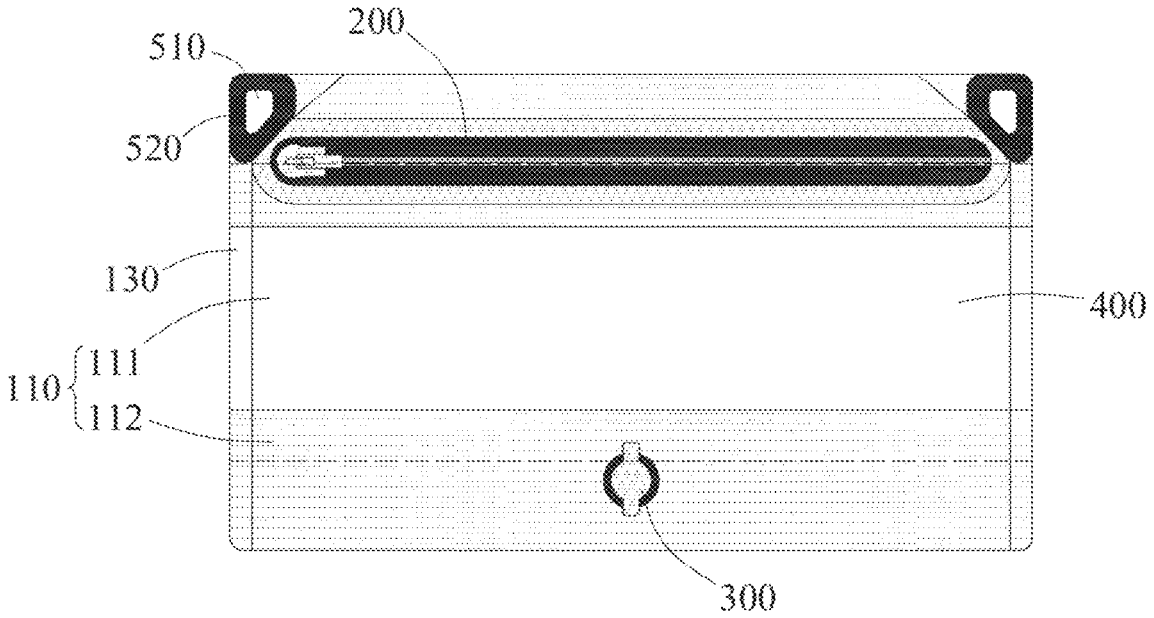
FIG. 11 is a front schematic structural view of a compression bag according to an embodiment of the present disclosure.
Figure 12:
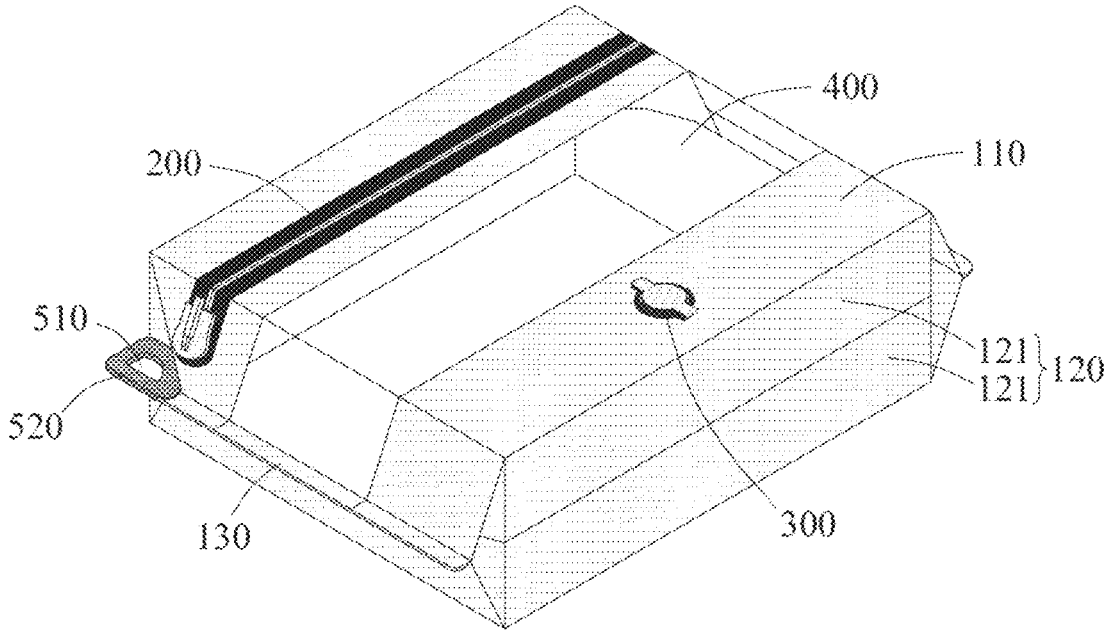
FIG. 12 is a 3D schematic structural view after air is inflated to the compression bag in FIG. 11.
Figure 13:
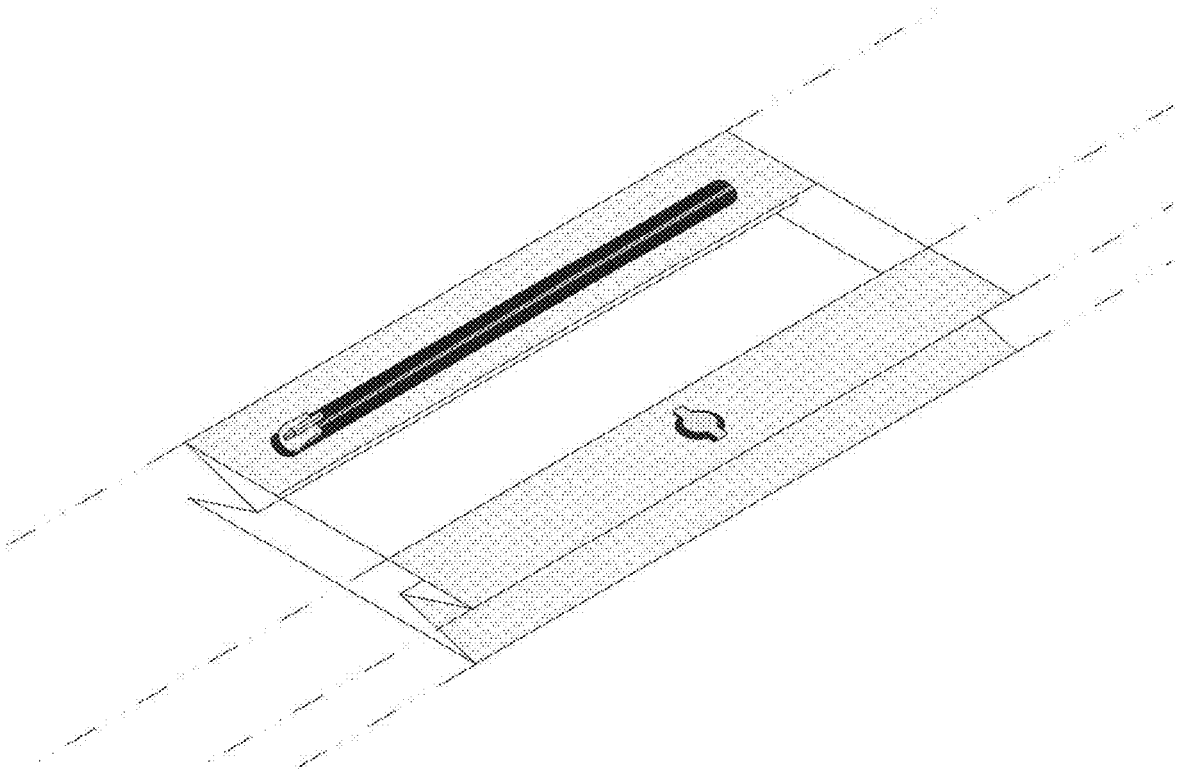
FIG. 13 is a schematic principle diagram of a cutting step in a manufacturing process of a compression bag according to an embodiment of the present disclosure.

Specifically, as shown in FIG. 7 and FIG. 11, the bag sheet 110 includes light-transmissive sheet 111 and connection sheets 112 respectively connected to two sides of the light-transmissive sheet 111. A portion of the light-transmissive sheet 111 not overlapped with the connection sheet 112 forms the viewing window 400. In the manufacture of the compression bag, the bag body 100 may be obtained by cutting a longer cylindrical structure. A cut-off position serves as the end of the bag body 100. The light-transmissive sheet 111 may be thermocompression-bonded to the connection sheets 112 at the two sides of the light-transmissive sheet 111. Then, as shown in FIG. 13, the cylindrical structure is cut into sections. Each section serves as one bag body 100.

It is to be understood that for the bag sheet 110 with the viewing window 400, an edge of the light-transmissive sheet 111 and an edge of the connection sheet 112 serve as the edge of the bag sheet 110. A manner in which edges of two ends of each of the light-transmissive sheet 111 and the connection sheet 112 are connected to other structures is the same as a manner of the common bag sheet 110. For example, at an end of the bag sheet 110 with the edge directly thermocompression-bonded, an edge of the light-transmissive sheet 111 corresponding to the end of the bag body 100 and an edge of the connection sheet 112 corresponding to the end of the bag body 100 are overlapped and thermocompression-bonded with the opposite bag sheet 110. At the end provided with the bottom bag sheet 500, an edge of the light-transmissive sheet 111 corresponding to one side of the bottom bag sheet 500 and an edge of the connection sheet 112 corresponding to one side of the bottom bag sheet 500 are thermocompression-bonded to the edge of the bottom bag sheet 500.

As an optional implementation of the present disclosure, light transmittance of the light-transmissive sheet 111 for natural light is not less than 30%.

Preferably, the light-transmissive sheet 111 is made of a frosted material, which is convenient for the user to observe and find the item in the bag, and protects the privacy of the user.

Figure 14:
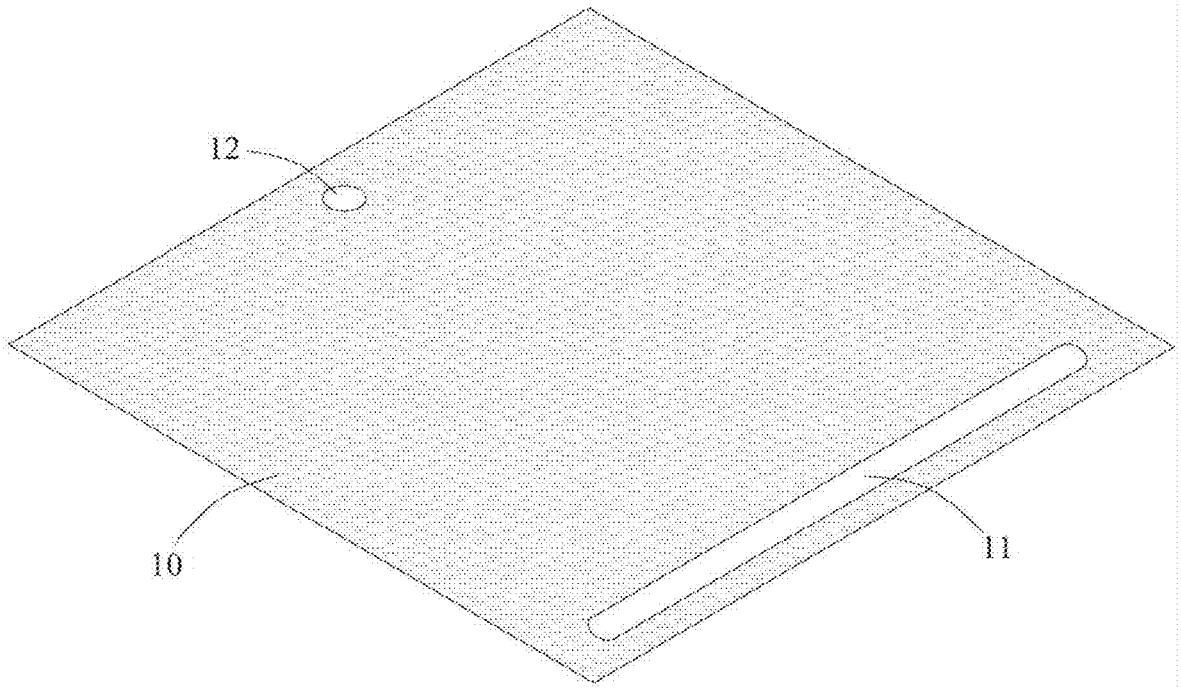
FIG. 14 to FIG. 19 are a schematic diagram of a manufacturing process of a compression bag according to an embodiment of the present disclosure.

To facilitate understanding by those skilled in the art, a specific manufacturing process of the compression bag provided in one embodiment of the present disclosure is provided hereinafter:

First of all, as shown in FIG. 14, the elongated hole 11 and the valve hole 12 of each bag body 100 are manufactured on sheet material 10 (which corresponds to the bottom bag sheet 110, the folding portion 120 and the connection sheet 112 of the top bag sheet 110 before folded. In the figure, only the corresponding length of the single bag body 100 is shown).

Figure 15:
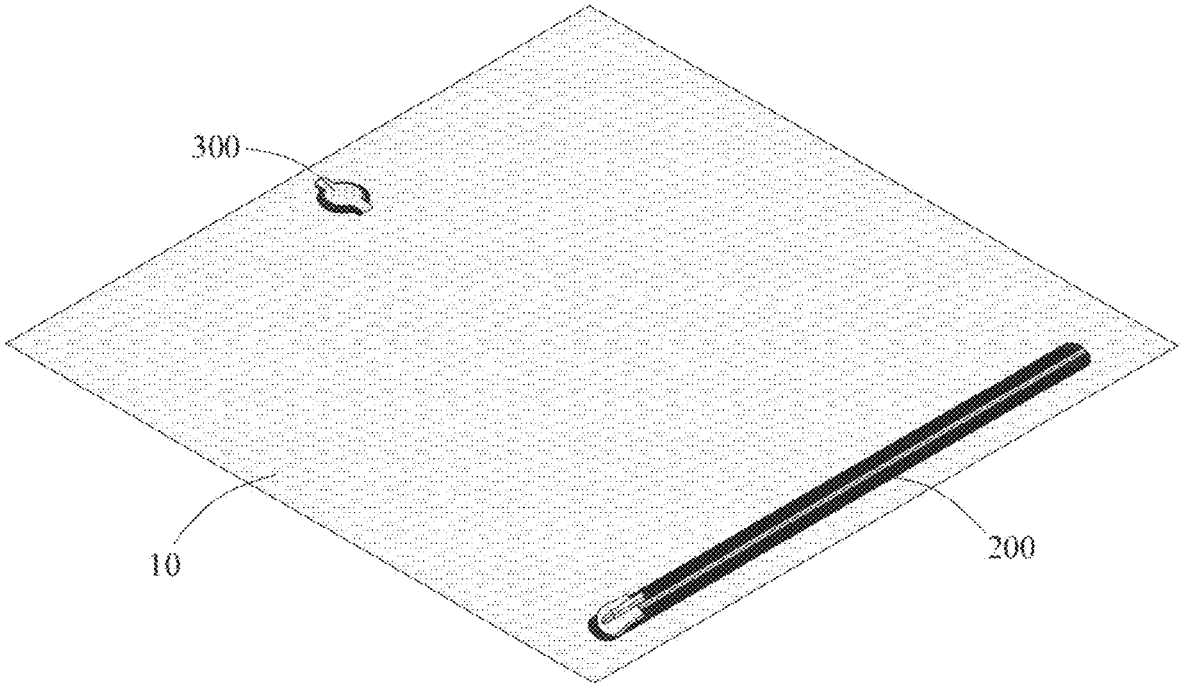

Then, as shown in FIG. 14 to FIG. 15, the sealing strip 200 is fixed in the elongated hole 11. The one-way valve 300 is fixed in the valve hole 12.

Figure 16:
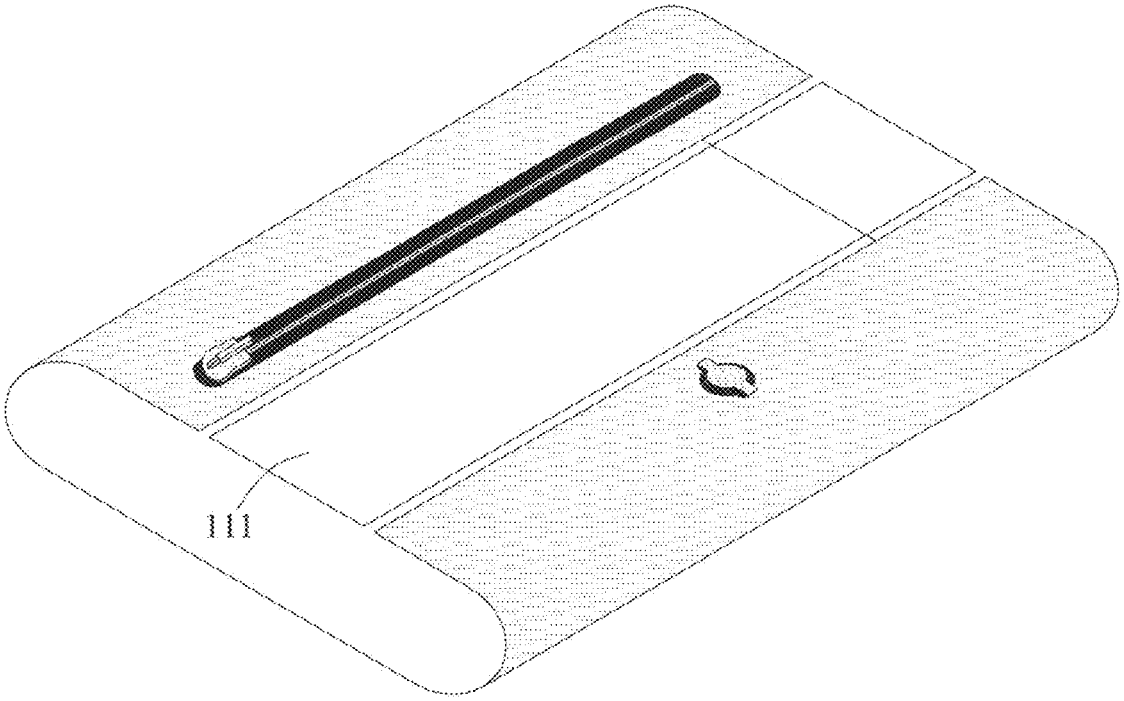
Figure 17:
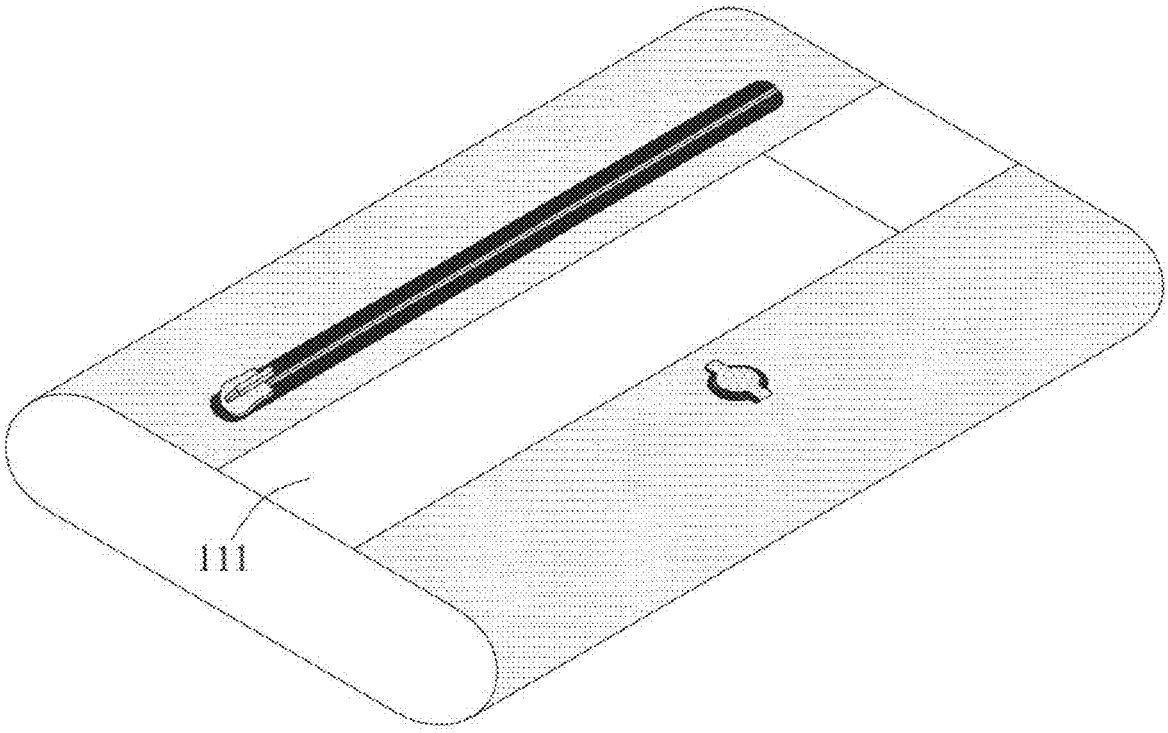

Next, as shown in FIG. 15 to FIG. 17, the sheet material 10 is rolled, with two side edges thermocompressed with side edges of the light-transmissive sheet 111 into a whole, thereby forming a cylindrical structure.

Figure 18:
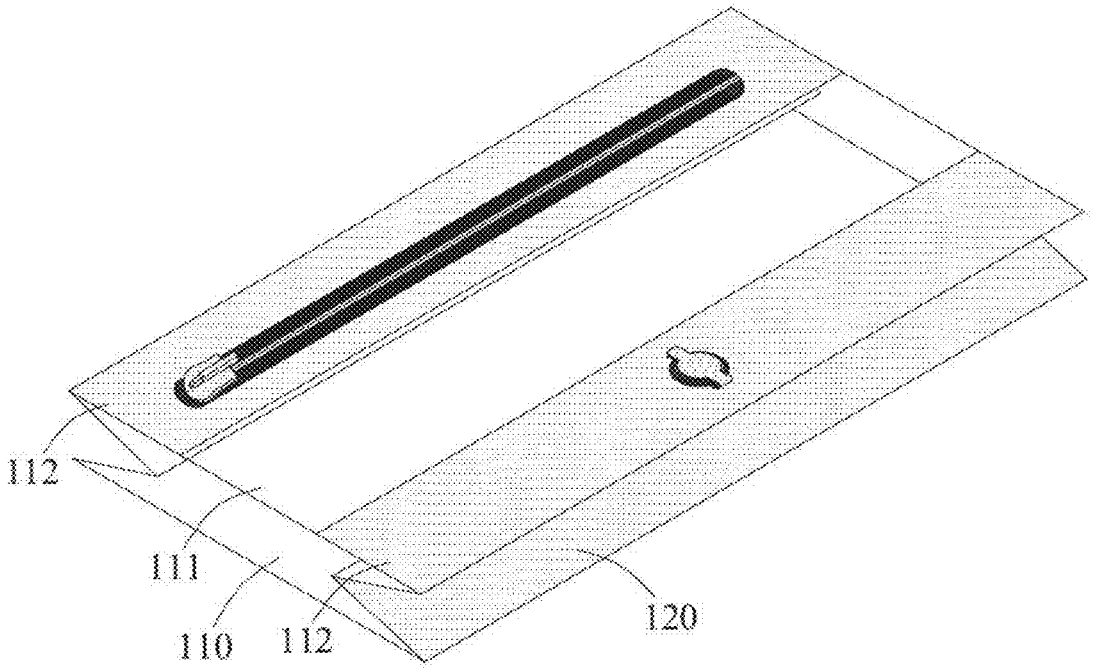

After that, as shown in FIG. 17 to FIG. 18, two sides of the cylindrical structure are respectively folded inwardly to form the folding portions 120. A bottom portion located between two folding portions 120 forms the bottom bag sheet 110. The top sheet material 10 is correspondingly folded to form the connection sheets 112. The connection sheets 112 and the light-transmissive sheet 111 therebetween jointly form the top bag sheet 110.

Figure 19:
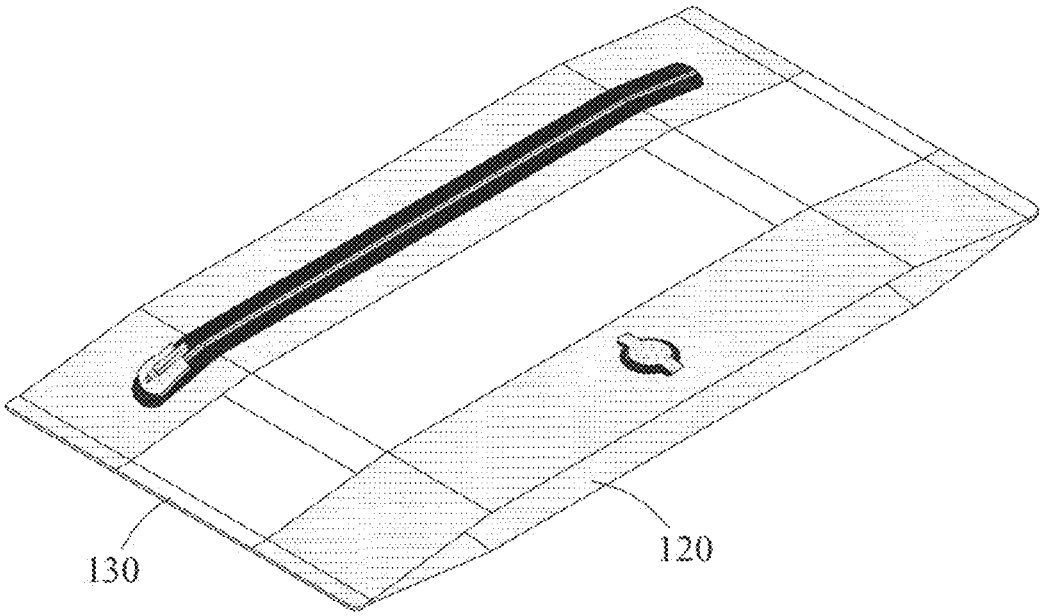

At last, as shown in FIG. 18 to FIG. 19, the folded cylindrical structure is cut in sections, with cut edges thermocompression-bonded to form laminated edges 130, thereby obtaining a plurality of compression bags provided by the present disclosure.

As an optional implementation of the present disclosure, as shown in FIG. 7, FIG. 8, FIG. 11, and FIG. 12, the sealing strip 200 and the one-way valve 300 are provided on the same bag sheet 110 as the viewing window 400, and are respectively located at two sides of the viewing window 400.

As a preferred implementation of the present disclosure, as shown in FIG. 7, FIG. 8, FIG. 11, and FIG. 12, an extension direction of the sealing strip 200 is parallel to an extension direction of the viewing window 400, such that when the sealing strip 200 is pulled, a counter-acting force can be applied to the laminated edge 130 at one side of the compression bag. During the pulling process, the sealed position is not pulled open to expose the internal items, improving the user experience.

As a preferred implementation of the present disclosure, as shown in FIG. 7, FIG. 8, FIG. 11, and FIG. 12, the one-way valve 300 is located at a center of a region of the bag sheet 110 corresponding to one side of the viewing window 400. This ensures uniformity of a material and a structure around the one-way valve 300, and prevents stress concentration around the one-way valve 300, ensuring structural strength of the compression bag.

As an optional implementation of the present disclosure, a material of the bag body 100 includes thermoplastic.

As an optional implementation of the present disclosure, the compression bag has a size of 150 mm to 500 mm along a width direction (an up-down direction in FIG. 1) in which the laminated edge 130 extends.

Further, as an optional implementation of the present disclosure, the compression bag has the size of 220 mm to 430 mm along the width direction.

As an optional implementation of the present disclosure, the compression bag has a size of 200 mm to 800 mm along a length direction (a left-right direction in FIG. 1).

Further, as an optional implementation of the present disclosure, the compression bag has the size of 370 mm to 670 mm along the length direction.

As an optional implementation of the present disclosure, the viewing window 400 has a size of 60 mm to 300 mm along the width direction.

Further, as an optional implementation of the present disclosure, the viewing window 400 has the size of 85 mm to 180 mm along the width direction.

As an optional implementation of the present disclosure, the lamination 121 has a width of 20 mm to 90 mm.

Further, as an optional implementation of the present disclosure, the lamination 121 has the width of 45 mm to 75 mm.

There are no specific limits made on a structural type of the sealing strip 200 in the embodiment of the present disclosure, provided that the airtightness of the compression bag can be ensured. For example, the sealing strip 200 may include a clamping chain. The clamping chain includes a slider, a concave buckling strip, and a convex buckling strip. Both the concave buckling strip and the convex buckling strip extend along the extension direction of the elongated hole, and are respectively fixedly provided at two side edges of the elongated hole. The slider is movable along the elongated hole, so as to engage or disengage the concave buckling strip and the convex buckling strip.

As a preferred implementation of the present disclosure, as shown in FIG. 1, the sealing strip 200 includes a zipper. The zipper includes slider 210, first teeth set 220, and second teeth set 230. The first teeth set 220 includes a plurality of first zipper teeth. The second teeth set 230 includes a plurality of second zipper teeth. The first teeth set 220 and the second teeth set 230 are respectively fixedly provided at two side edges of the elongated hole, and distributed along an extension direction of the elongated hole. The slider 210 is configured to move along the elongated hole and engage or disengage the first teeth set 220 and the second teeth set 230.

In the embodiment of the present disclosure, the zipper structure is used to seal the elongated hole. With stable structure, high strength and wear resistance, the zipper structure still can keep the sealing effect after used repeatedly. This can effectively ensure service life of the compression bag and product yield of the compression bag.

As an optional implementation of the present disclosure, as shown in FIG. 1, the zipper further includes first connection sheet 240 and second connection sheet 250. The first teeth set 220 is fixedly provided on the first connection sheet 240. The second teeth set 230 is fixedly provided on the second connection sheet 250. An outer edge of the first connection sheet 240 and an outer edge of the second connection sheet 250 are respectively thermocompression-bonded to the two side edges of the elongated hole.

Figure 23:
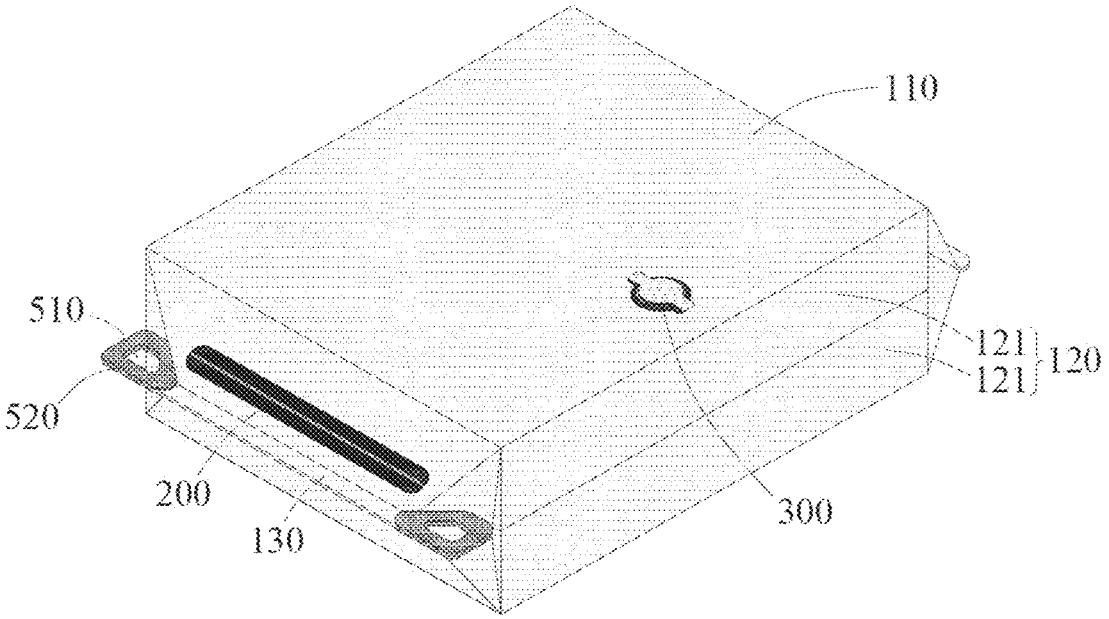
FIG. 23 is a schematic structural view of a compression bag according to another embodiment of the present disclosure.

To facilitate force application during opening or closing of the sealing strip 200, as a preferred implementation of the present disclosure, as shown in FIG. 9 to FIG. 12, the sealing strip 200 extends from one end of the bag body 100 to the other end of the bag body 100. Alternatively, as shown in FIG. 23, FIG. 24, and FIG. 25, the sealing strip extends along an edge of an end of the bag body 100. As shown in FIG. 9 to FIG. 12, FIG. 23, FIG. 24, and FIG. 25, force application hole 510 is formed in laminated edge 130 of the end of the bag body 100. The force application hole 510 penetrates through the laminated edge 130 along a thickness direction. A position of the force application hole 510 corresponds to a position of an end of the sealing strip 200.

In the embodiment of the present disclosure, with the force application hole 510 at the end of the sealing strip 200, when the sealing strip 200 is opened or closed, the slider is pulled by one hand, and a finger of the other hand is inserted into the force application hole 510 to apply a counter-acting force. This is more convenient to open or close the sealing strip 200 to take or place the item.

As a preferred implementation of the present disclosure, as shown in FIG. 9 to FIG. 12, FIG. 23, FIG. 24, and FIG. 25, two ends of the sealing strip 200 each are correspondingly provided with the force application hole 510. When the sealing strip 200 is opened and closed, a force may be applied to the force application hole 510 of the corresponding side.

To further ensure the structural strength of the compression bag, as an optional implementation of the present disclosure, as shown in FIG. 9 to FIG. 12, FIG. 23, FIG. 24, and FIG. 25, laminated edge reinforcing portion 520 is further provided on the laminated edge 130. The laminated edge reinforcing portion 520 is overlaid on the laminated edge 130. The force application hole 510 penetrates through the laminated edge reinforcing portion 520 and the laminated edge 130 along the thickness direction.

In the embodiment of the present disclosure, the laminated edge reinforcing portion 520 is further provided on the laminated edge 130 and corresponding to the force application hole 510. This additionally reinforces the force application hole 510, ensuring the structural strength at a stressed position of the compression bag, and further ensuring product quality of the compression bag.

As an optional implementation of the present disclosure, the force application hole 510 is located at a corner of the bag body 100. The force application hole 510 is in the shape of any one of a triangle, an approximate triangle, a trapezoid, and an approximate trapezoid. For example, as shown in FIG. 9 to FIG. 12, FIG. 23, FIG. 24, and FIG. 25, the force application hole 510 is in the shape of a trapezoid with a filleted corner.

As an optional implementation of the present disclosure, as shown in FIG. 9 to FIG. 12, FIG. 23, FIG. 24, and FIG. 25, the laminated edge reinforcing portion 520 corresponds to the force application hole 510 in shape.

As an optional implementation of the present disclosure, the laminated edge reinforcing portion 520 and the laminated edge 130 are thermocompression-bonded.

As an optional implementation of the present disclosure, a material of the laminated edge reinforcing portion 520 is the same as a material of the lamination 121.

As a preferred implementation of the present disclosure, the laminated edge reinforcing portion 520 is made of a rubber material, to ensure a force of friction between the finger and the compression bag when the sealing strip 200 is pulled.

As an optional implementation of the present disclosure, the bag sheet 110 and the lamination 121 each have a thickness of 0.3 mm to 0.8 mm.

Preferably, the bag sheet 110 and the lamination 121 each have the thickness of 0.4 mm to 0.5 mm.

As an optional implementation of the present disclosure, the bag sheet 110 and the lamination 121 each have the thickness of 0.45 mm.

As an optional implementation of the present disclosure, the laminated edge reinforcing portion 520 has a thickness of 0.1 mm to 0.3 mm.

Preferably, the laminated edge reinforcing portion 520 has the thickness of 0.2 mm.

Figure 20:
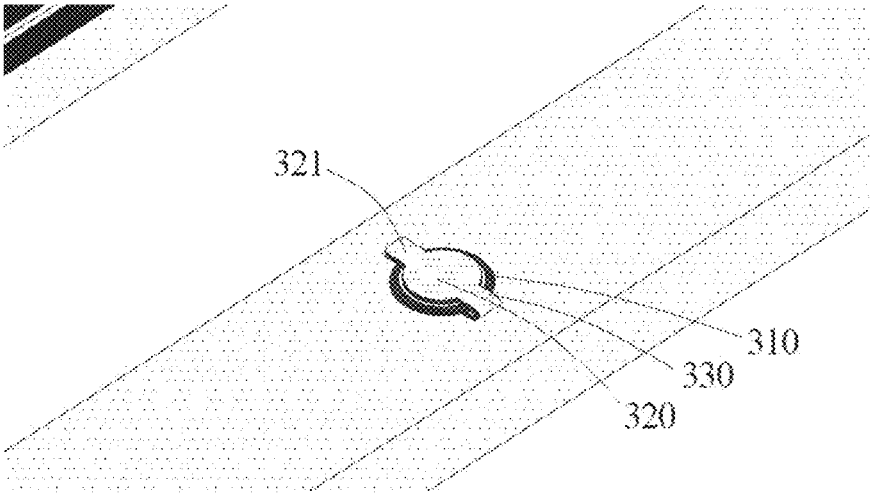
FIG. 20 is a partial schematic structural view of a compression bag according to an embodiment of the present disclosure.

As an optional implementation of the present disclosure, as shown in FIG. 20, the one-way valve 300 includes valve body 310, sealing cover 320, and flexible connecting portion 330. The valve body 310 is fixedly provided in the valve hole, and allows unidirectional flow from inside to outside. The sealing cover 320 is connected to the valve body 310 through the flexible connecting portion 330. The sealing cover 320 can be configured to seal an air outlet of the valve body 310, so as to prevent a sharp item outside the compression bag from damaging the valve disc and other structures in the valve body 310, further ensuring the structural strength of the compression bag.

As an optional implementation of the present disclosure, the valve body 310 includes a valve seat and a valve disc. The valve seat is fixedly provided in the valve hole, and an outlet chamber is formed in the valve seat. The air outlet is formed in a top of the outlet chamber. A communicating hole communicating with an interior of the bag body 100 is formed in a bottom of the outlet chamber. The valve disc is movably provided in the outlet chamber, and can be configured to block the communicating hole under an air pressure outside the bag body 100.

As a preferred implementation of the present disclosure, as shown in FIG. 20, a side of the sealing cover 320 away from the flexible connecting portion 330 is provided with holding portion 321. The holding portion 321 extends along a direction away from the flexible connecting portion 330. As a result, when the sealing cover 320 is pulled open, the holding portion 321 can be held by the user to apply a force conveniently, further improving convenience of the compression bag in use.

In the present disclosure, two sides of the compression bag are respectively provided with the inwardly folded folding portions 120. Through expansion and contraction of the folding portions 120, flexible storage space can be provided for the clothing in the bag. Moreover, the sealing strip 200 is further fixedly provided on the compression bag. The sealing strip can be configured to selectively open the elongated hole to take and place the clothing conveniently, or seal the elongated hole to prevent outside air from entering the compression bag. The one-way valve 300 allows unidirectional flow from inside to outside, ensuring that air is evacuated to the outside, and the outside air is prevented from entering the compression bag upon evacuation, keeping the interior of the compression bag at a low pressure.

Furthermore, the bag body of the compression bag is a cylindrical structure before two ends of the bag body are sealed. At two sides of the bag body, the folding portions 120 for changing a volume through expansion and contraction and the bag sheets 110 connected between the folding portions 120 are all obtained by folding different parts of the same bag body 100. Only the end of the bag body 100 is provided with the opening. After the bag body is sealed, the laminated edge 130 is only formed at the end of the bag body. Compared with the spliced bag body in the related art, the present disclosure can effectively improve airtightness of the compression bag. Besides, an edge of at least one end of the bag body 100 is sealed by thermocompression to form the laminated edge 130. This prevents adhesive failure, water seepage, air leakage and the like of the adhesion solution, and further ensures the airtightness of the compression bag, thereby ensuring storage efficiency as well as moisture-proof, mildew-resistant and anti-odor effects of the compression bag.

The above described are only specific implementations of the present disclosure, which do not constitute a limitation on the protection scope of the present disclosure. Those skilled in the art should understand that the present disclosure includes but is not limited to the content described in the above accompanying drawings and the above specific implementations. Any modification without departing from the functional and structural principles of the present disclosure falls within the scope of the claims.

What is claimed is:

1. A compression bag, comprising a bag body, a sealing strip, and a one-way valve, wherein two sides of the bag body are respectively folded inwardly to form folding portions; portions between the folding portions respectively form bag sheets; two ends of the bag body are sealed; an edge of at least one end of the bag body is thermocompression-sealed; an elongated hole and a valve hole are formed in the bag body; the sealing strip is fixedly provided in the elongated hole, and is configured to selectively open or seal the elongated hole; the one-way valve is fixedly provided in the valve hole; and the one-way valve allows unidirectional flow from inside to outside, ensuring that a fluid in the compression bag is discharged through the valve hole.

2. The compression bag according to claim 1, wherein edges of the two ends of the bag body are thermocompression-sealed; or an edge of a first end of the bag body is thermocompression-sealed; a second end of the bag body is provided with a bottom bag sheet; and a periphery of the bottom bag sheet is thermocompression-bonded to a corresponding bag sheet and a corresponding folding portion to seal the second end of the bag body.

3. The compression bag according to claim 2, wherein the folding portion comprises a pair of folding sheets stacked between the bag sheets; at the at least one end of the bag body with the thermocompression-sealed edge, edges of the pair of folding sheets corresponding to the at least one end of the bag body are respectively thermocompression-bonded to edges of adjacent bag sheets, and edges of ends of the adjacent bag sheets located between the folding portions are thermocompression-bonded to each other; and at the second end of the bag body provided with the bottom bag sheet, edges of ends of the pair of folding sheets are thermocompression-bonded to an edge of the bottom bag sheet.

4. The compression bag according to claim 3, wherein edges of the pair of folding sheets of at least one folding portion corresponding to at least one side of the end of the bag body are thermocompression-bonded to each other.

5. The compression bag according to claim 1, wherein a viewing window is formed on the bag body; and light transmittance of the viewing window of the bag body is greater than light transmittance of other regions of the bag body.

6. The compression bag according to claim 5, wherein the viewing window is located on the bag sheet, and the viewing window extends from a first end of the bag body to a second end of the bag body.

7. The compression bag according to claim 6, wherein the sealing strip and the one-way valve are provided on the same bag sheet as the viewing window; and the sealing strip and the one-way valve are respectively located at two sides of the viewing window.

8. The compression bag according to claim 7, wherein the one-way valve is located at a center of a region of the bag sheet corresponding to one side of the viewing window.

9. The compression bag according to claim 6, wherein the bag sheet comprises a light-transmissive sheet and connection sheets respectively connected to two sides of the light-transmissive sheet; and a portion of the light-transmissive sheet not overlapped with the connection sheet forms the viewing window.

10. The compression bag according to claim 1, wherein the sealing strip extends from a first end of the bag body to a second end of the bag body, or the sealing strip extends along an edge of an end of the bag body; and a force application hole is formed in a laminated edge of the two ends of the bag body; the force application hole penetrates through the laminated edge along a thickness direction; and a position of the force application hole corresponds to a position of an end of the sealing strip.

11. The compression bag according to claim 10, wherein a laminated edge reinforcing portion is further provided on the laminated edge; the laminated edge reinforcing portion is overlaid on the laminated edge; and the force application hole penetrates through the laminated edge reinforcing portion and the laminated edge along the thickness direction.

12. The compression bag according to claim 11, wherein the laminated edge reinforcing portion and the laminated edge are thermocompression-bonded.

* * * * *